US005346363A

United States Patent [19]

Stallman et al.

[11] Patent Number: 5,346,363

[45] Date of Patent: Sep. 13, 1994

[54] LINER FOR A WATER JET PROPULSION PUMP

[75] Inventors: Richard C. Stallman; William T. Stallman, both of Alameda, Calif.

[73] Assignee: Outboard Jet - Trutol Bearings, Inc., San Leandro, Calif.

[21] Appl. No.: 52,168

[22] Filed: Apr. 23, 1993

[51] Int. Cl.[5] ..... F04D 29/02

[52] U.S. Cl. ..... 415/197; 415/128

[58] Field of Search ..... 415/128, 196, 197, 214.1

[56] References Cited

U.S. PATENT DOCUMENTS

| | | | |
|---|---|---|---|
| 3,082,732 | 3/1963 | Stallman . | |
| 3,094,075 | 6/1963 | Logue | 415/197 |
| 3,115,099 | 12/1963 | Clay | 415/197 |
| 3,160,106 | 12/1964 | Ashworth | 415/197 |
| 3,209,534 | 10/1965 | Stallman . | |
| 3,367,116 | 2/1968 | Stallman | 415/197 |
| 3,442,220 | 5/1969 | Mottram et al. . | |
| 3,771,900 | 11/1973 | Baehr . | |
| 4,004,541 | 1/1977 | Onal . | |
| 4,080,099 | 3/1978 | Snyder . | |
| 4,176,616 | 12/1979 | Robins . | |
| 4,334,826 | 6/1982 | Connolly et al. . | |
| 4,437,841 | 3/1984 | Stallman . | |
| 4,459,117 | 7/1984 | Jordan . | |
| 4,648,796 | 3/1987 | Maghenzani . | |
| 4,792,282 | 12/1988 | Jordan . | |

*Primary Examiner*—Edward K. Look
*Assistant Examiner*—Mark Sgantzos
*Attorney, Agent, or Firm*—Bruce & McCoy

[57] ABSTRACT

A liner of the intake casing for a water jet propulsion pump wherein the liner is made of a resilient material and is disposed internally of said casing surrounding the water impeller and is clamped in position by the pump assembly.

2 Claims, 1 Drawing Sheet

LINER FOR A WATER JET PROPULSION PUMP

BACKGROUND OF THE INVENTION

1. Field of the Invention

The present invention relates to an improved liner for the intake casing of a water jet propulsion pump. More particularly, the invention relates to a water jet propulsion pump which is an after market modification to an outboard motor used on small boats. The water jet propulsion pump, called a jet drive, replaces the propeller at the lower end of the outboard motor drive shaft.

The improved liner of the present invention for the intake casing of the jet drive is an accessory element which serves essentially two purposes: it increases the wear resistance of the jet drive intake casing to internal abrasion from ingested sand and gravel, and it lessens the likelihood of damage to the jet drive assembly by insulating the jet drive intake casing from the rest of the jet drive assembly with a shock absorbing material.

2. Description of the Prior Art

The inventor of the present invention is the originator and developer of water jet propulsion pump conversion units for outboard motors for boats. The history of the industry is chronicled by his patents which are included herein by reference.

Water jet propulsion pump conversions for outboard motors have a unique advantage over propeller drives which make them highly desirable in comparison to propeller drives for specific applications. Propeller drives are extremely vulnerable to damage due to the relatively fragile and intricate configuration of the propeller. Slight deformation of only one of the usually multiple blades of a propeller will greatly decrease if not destroy the efficiency of the propeller output. Even slight damage to a propeller blade due to a strike with an object can completely disable a motor by causing the motor to vibrate so violently as to dislocate the connection of the motor to the boat or to damage the motor or the boat by continued operation of the motor. For this reason, propeller-driven outboard motors cannot be utilized safely in shallow water where a propeller strike on the bottom might occur.

There are many shallow rivers and streams in the world where boats are needed for transportation and can be run if the use of a propeller-driven propulsion unit can be avoided. As a result of this need, the inventor hereof has developed water jet propulsion pumps to replace the propellers on standard outboard motors so that shallow water running can be accomplished by outboard motor powered boats, and these improvements in the art have been patented and are included hereby by reference.

The first of said patents was issued Mar. 26, 1963, under U.S. Pat. No. 3,082,732 for a Water Jet Motor for Boats. FIG. 1 of that patent shows an outboard motor 1 attached to a boat 2 and having a jet pump 4 attached to the lower end of the outboard motor. The jet drive has an intake section 7 which ingests water to the casing 8 which is then driven by the impeller 9, shown in FIG. 4, into the pump section. The impeller 9 is driven by the outboard motor drive shaft 10 and has vanes or blades 12 in the form of a screw which pressurize water through the recuperation section 13. The impeller accelerates the mass of the ingested water through the recuperation section 13 and out the nozzle 14 causing the reaction to drive the boat through the river or stream.

An improvement patent issued to the inventor of the present invention on Oct. 5, 1965, under U.S. Pat. No. 3,209,534 for Outboard Motor Exhaust System. That patent shows improvements in the means of operation of the earlier patented invention.

Another improvement patent was issued to the present inventor on Feb. 6, 1968, under U.S. Pat. No. 3,367,116 for An Intake Grill for Water Jet Pump. While this patent is directed to subject matter not related to the present invention, subject matter related to the present invention is disclosed therein but not claimed. FIGS. 3 and 5 thereof show the jet drive impeller 9 disposed in the intake casing 8. The casing is provided with a liner 16 which is supplied for the purpose of providing abrasion resistance to sand and gravel which might be ingested from a river bed or stream bottom and expelled through the pump. This liner is the closest known prior art to the present invention. However, it had several defects which were not easily overcome, and it did not prove successful until improvements were developed for the present invention almost 15 years later.

A further development in the art of jet drives was effected by the present inventor and is disclosed in the patent issued on Mar. 20, 1984, under U.S. Pat. No. 4,437,841 for An Outboard Jet Drive Steering Mechanism. The improvement permits jet boats to run in the very shallowest water possible that the boat can float in. There shown in FIGS. 1–3 is a current conceptualization of the jet drive apparatus illustrating the recuperation section as a nautilus type spiral volute. While the volute is not specifically numbered, it is designated by the numerals "28" in FIG. 1 and "20" in FIGS. 2 and 3. Disposed in the spiral volute of the jet drive assembly are the impeller blades 50, FIG. 1, which pressurize the water for expulsion out the jet drive nozzle 32. The volute is positioned immediately above the intake casing 52, FIG. 1, and 28, FIG. 3, in which the jet pump impeller 50, FIG. 1, is disposed.

SUMMARY OF THE INVENTION

The present invention is an improved liner for a water jet propulsion pump called a jet drive. The liner is disposed at the interface between the jet drive water impeller and the pump intake casing. The casing is removably secured to the pump volute of the jet drive. The liner is a resilient hollow truncated inverted cone-shaped sleeve disposed between the peripheral ends of the blades of the impeller and the internal walls of the pump intake casing. The outer surface of the liner is shaped to conform to the internal walls of the casing and the internal surface of the liner is shaped to mate in close surrounding spaced relation to the impeller blade peripheral ends. An integral flange extends from the external peripheral surface of the liner and is formed for being sandwiched between the opposing mating surfaces of the jet drive volute and the intake casing.

OBJECTS OF THE INVENTION

It is therefore an important object of the present invention to provide a liner for a water jet propulsion pump intake casing which reduces internal abrasion wear from the ingestion of sand and gravel through the jet drive water intake.

It is another object of the present invention to provide a shock absorbing insulator in a water jet propulsion pump, between the jet drive volute and the jet drive intake casing, to minimize damage to the assembly when the jet drive water intake strikes the river bed or stream bottom, a submerged rock, or other debris.

It is a further object of the present invention to provide a means in a water jet propulsion pump for securely holding a liner in the jet drive intake casing to prevent spinning of the liner during impeller jams by securely clamping the liner between opposing parts of the jet drive assembly.

And it is still another object of the present invention to facilitate the removal of a jet drive intake casing from a water jet propulsion pump, when the impeller thereof is immobilized by a sand jam, by the use of a resilient liner disposed inside the intake casing.

Other objects and advantages of the present invention will become apparent when the apparatus thereof is considered in conjunction with the accompanying drawings.

DESCRIPTION OF THE PREFERRED EMBODIMENT

Figure 1:
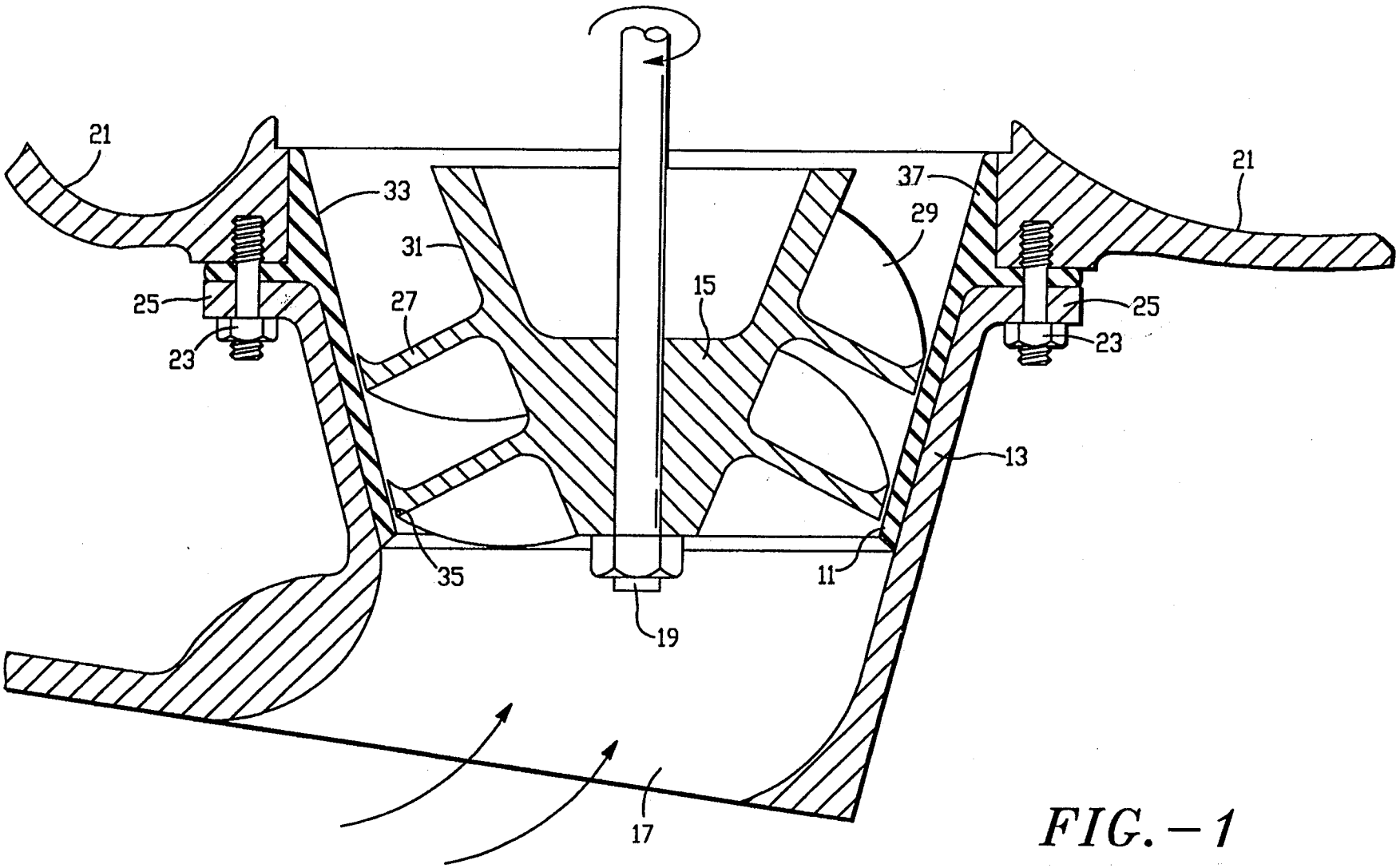
FIG. 1 is a partial cross-section view of the lower end of a water jet propulsion pump illustrating the intake casing, the jet drive impeller, and the lower portion of the pump volute.

Reference is made to the drawings for a description of the preferred embodiment of the present invention wherein like reference numbers represent like elements on corresponding views.

The present invention illustrated in FIG. 1 of the drawings is an improved liner 11 for the intake casing 13 of a water jet propulsion pump for outboard motors for boats, herein called a jet drive. The basic components of the jet drive related to the invention include the jet pump intake casing which is the lowest member of the assembly and which ingests water for acceleration or pressurization by the water accelerator or impeller 15. The intake casing has an inlet opening 17 angled upward with respect to the forward motion of the boat to facilitate the intake of water. The casing is internally streamlined to direct the ingested water upwards towards the impeller disposed within the walls of the intake casing and located directly above the inlet opening. The impeller is secured to the lower end of the outboard motor drive shaft 19.

The jet drive intake casing 13 is a separate unit or casting which is removably secured to the pump volute 21 of the recuperation section of the jet drive assembly for easy removal to break impeller jams and for replacement in the event of breakage. The casing is secured to the volute by studs and self-locking nuts 23 which project through the surrounding flange 25 formed on the upper edge of the intake casing to coincide with the circular opening in the pump volute. The volute is an expanding spiral nautilus type chamber which conducts the flow of the ingested water to the jet drive nozzle.

The jet drive impeller 15 has a multiple of blades 27 in the form of a screw. The swept volume created by the impeller blade sweep in the conduit formed by the intake casing 13 is a truncated inverted cone. The upper surfaces 29 of the impeller blades are the pressure sides of the blade which impose force on the water to push it through the pump. The impeller has an inverted cone-shaped hub 31 with the blades projecting generally perpendicular therefrom toward the internal walls 33 of the liner 11 disposed in the jet pump intake casing.

The peripheral ends 35 of the impeller blades 27 form a seal with the internal walls 33 of the intake casing liner 11 by being closely spaced thereto. In the preferred embodiment of the present invention, the internal walls of the intake casing 13 and the liner, in the area surrounding the impeller 15, are straight-sided for several reasons. The walls form a section of a hollow truncated inverted cone-shaped conduit in which the impeller is located. In many pump impeller casings, the walls are curvilinear for pump efficiency.

A primary problem associated with jet drives for shallow water running of motor boats is the ingestion of sand and gravel into the water pump. While this is an expected and natural result of running a jet drive water intake close to the bottom of river beds and streams, there are several problems which result. First and foremost, of course, is internal abrasion caused by the ingestion of such hard and sharp surfaced minerals. While it is obvious this can be resisted by providing harder metal in the jet drive components which contain the abrasive water flow, such materials are expensive and more difficult to fabricate than the lighter-weight easily-castable metals preferred for jet drives. A second more particular problem occurs from the ingestion of sand which jams the impeller blade inside the casing by wedging in the spacing of the seal between the peripheral ends 35 of the impeller blades 27 and the internal wall 33 of the intake casing 13. In a metal to metal jam, with a sand interface, it sometimes is very difficult to disassemble the locked up unit.

Due to the wear caused by the high abrasion environment of the jet drive intake casing, and the possibility of an impeller jam from the ingestion of sand and gravel, it is necessary to provide an easy means for adjusting the clearance between peripheral ends or edges 35 of the impeller blades 27 and the internal walls 33 of the intake casing 13 to accommodate the wear and to facilitate disassembly of the impeller 15 and intake casing to unlock a sand jam. These results are most easily effected if the internal walls of the jet drive intake casing are straight-sided. The two straight-sided parts are most easily separated, and simple raising or lowering of the impeller in the casing changes the clearance uniformly along the length of the portion of the casing surrounding the impeller to adjust the blade clearance.

The prior art of U.S. Pat. No. 3,367,116 shows a liner for the jet drive intake casing which is provided to resist abrasion due to ingestion of sand and gravel. The liner 16 illustrated therein, FIGS. 3 & 5, is bonded to a removable rigid backing member 17 which is held in the intake casing 8 by locking screws 18. The problem is that jams cause the liner to break the bond with the backing and spin in the backing member. No satisfactory solution to the problem has been found.

The resilient liner 11 of the present invention overcomes this problem and makes it easier to disassemble the unit when a sand jam causes an impeller lockup. During disassembly, the interface of the resilient liner permits the impeller 15 to be more easily disengaged from the intake casing 13. This occurs either because the intake casing slides off the liner, which in turn can then be more easily removed from the impeller, or the liner deforms slightly during removal of the intake casing to permit them to be removed together from the impeller. Thus, a resilient liner positioned between the moving parts of the jet drive, the impeller and the surrounding intake casing, facilitates the unlocking of sand jams.

The jet drive intake casing 13 is the most vulnerable part of the jet drive assembly because it is necessarily positioned unprotected at the lowest point in the assembly to effect water ingestion. As a result, it is exposed to the possibility of running at high speed when in shallow water into rocks in the river beds and stream bottoms. Therefore, it is subject to breakage.

Before the development of the resilient liner 11 of the present invention, the shock of the intake casing 13 striking rocks was transmitted to the jet pump volute 21 thereby causing the possibility of damage to the whole jet drive assembly. The liner was developed as an insulator, as well as an abrasion protector, to provide shock absorption protection to the other elements of the jet drive by insulating the intake casing from the remainder of the assembly. Thus, the intake casing is designed so it is removably secured to the pump volute to permit easy disassembly to clear impeller jams and for quick replacement in case of breakage. The design also permits the shock absorbing resilient liner to be interposed between the intake casing and the rest of the jet drive assembly.

The improved liner 11 of the present invention is formed as a resilient hollow truncated inverted cone-shaped sleeve which is disposed between the peripheral ends 35 of the blades 27 of the impeller 15 and the internal walls 33 of the pump intake casing 13. The outer surface of the liner is shaped to conform to the internal walls of the casing while the internal surface of the liner is shaped to mate in close surrounding spaced relation to the impeller blade peripheral ends. The resilient liner is formed from a rubber-like compound of such as urethane or ataprene.

In the preferred configuration of the invention, an integral flange 25 extends from the external peripheral surface of the liner 11 and is formed for being sandwiched between the opposing mating surfaces of the jet drive volute 21 and the jet pump intake casing 13. It serves as a gasket but functions as a resilient shock absorbing interface between the two metal structures and insulates shocks to the intake casing from the rest of the jet drive assembly.

The preferred embodiment of the improved liner 11 also includes an extension ring 37 which projects beyond the integral flange 25 into the pump volute 21. The external surface of the extension ring is shaped to project into and conform to the internal walls of the volute while the internal surface of the extension ring is a continuation of the internal wall of the liner formed for mating with the impeller blade peripheral ends 35.

The resilient liner of the present invention overcomes the problems of the '116 patent and prevents the liner from breaking loose and spinning in the intake casing of the jet drive. It is disposed at interface between the impeller blade peripheral ends and the internal walls of the intake casing, and it is interposed between the intake casing 13 and the pump volute 21. It provides three advantages: (1) it is abrasion resistant; (2) in those circumstances where the unit must be disassembled to break a lockup, the resiliency of the liner facilitates the separation; and (3) it absorbs shock to the intake casing from rock, debris and bottom strikes.

Thus it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. An improved liner for a water jet propulsion pump called a jet drive having a pump volute with an intake casing removably secured thereto and a water impeller disposed in said casing, said impeller having blades with peripheral ends disposed proximate to the internal wall of said casing and which sweep a truncated cone-shaped volume, said liner comprising a resilient hollow truncated inverted cone-shaped sleeve disposed between said impeller blade peripheral ends and the internal wall of said intake casing, the outer surface of said liner shaped to conform to said internal wall of said casing, the internal surface of said liner shaped to mate in close surrounding spaced relation to said impeller blade peripheral ends, and an integral flange extending from the external surface of said liner and formed for being sandwiched between said pump volute and said intake casing.

2. The jet drive liner of claim 1 wherein said liner includes an extension ring which projects beyond said integral flange into said pump volute, the external surface thereof shaped to conform to the adjacent internal wall of said volute and the internal surface thereof being a continuation of the internal wall of said liner formed for mating with said impeller blade peripheral ends.

* * * * *